US005358839A

United States Patent [19]

Fukazawa

[11] Patent Number: 5,358,839

[45] Date of Patent: Oct. 25, 1994

[54] PROCESS FOR PRODUCING SILVER HALIDE PHOTOGRAPHIC LIGHT-SENSITIVE MATERIAL AND PRODUCT THEREBY

[75] Inventor: Fumie Fukazawa, Hino, Japan

[73] Assignee: Konica Corporation, Tokyo, Japan

[21] Appl. No.: 9,577

[22] Filed: Jan. 26, 1993

[30] Foreign Application Priority Data

Jan. 31, 1992 [JP] Japan ..... 4-015849

[51] Int. Cl.[5] ..... G03C 1/005; G03C 1/035

[52] U.S. Cl. ..... 430/567; 430/569

[58] Field of Search ..... 430/569, 567

[56] References Cited

U.S. PATENT DOCUMENTS 5,206,134 4/1993 Yamada et al. ..... 430/569
5,225,319 7/1993 Fukazawa et al. ..... 430/569
5,238,805 8/1993 Saitoy ..... 430/569

FOREIGN PATENT DOCUMENTS 185100 6/1986 European Pat. Off. .
0435270 7/1991 European Pat. Off. ..... 430/569
462528 12/1991 European Pat. Off. .

*Primary Examiner*—Charles L. Bowers, Jr.
*Assistant Examiner*—Mark F. Huff
*Attorney, Agent, or Firm*—Jordna B. Bierman

[57] ABSTRACT

A process for producing a silver halide photographic material and a photographic material produced thereby are disclosed. The process comprises the steps of (1) forming a seed emulsion comprising silver halide seed grains, (2) growing the seed grains to prepare a silver halide photographic emulsion by supplying a silver ion component and a halide ion component to the mother liquid of the seed emulsion, (3) coating and drying the photographic emulsion on a support to form the silver halide emulsion layer, and at least a period during the step for growing the seed grains is performed in the presence of silver iodide grains, and an oxidant capable of converting metallic silver to silver ions is added at a time during the step for growing the seed grains.

26 Claims, No Drawings

PROCESS FOR PRODUCING SILVER HALIDE PHOTOGRAPHIC LIGHT-SENSITIVE MATERIAL AND PRODUCT THEREBY

FIELD OF THE INVENTION

The present invention relates to a process for producing a silver halide photographic light-sensitive material and a silver halide light-sensitive material produced thereby, the silver halide photographic light-sensitive material has high sensitivity and excellent granularity, particularly excellent graininess in long-term storage.

BACKGROUND OF THE INVENTION

There has been constant demand for further sensitivity improvement in silver halide grains.

As a means of meeting this demand, grains such as those disclosed in Japanese Patent Publication Open to Public Inspection (hereinafter referred to as Japanese Patent O.P.I. Publication) No. 143331/1985 are available, which are so-called core-shell grains, wherein the silver iodide content in the inner portion is higher than that in the outer portion.

Later, investigations were made for more constant obtainment of the effect of high sensitivity. Silver halide grains having no failures in the inner phase containing silver iodide, a highly uniform silver halide composition and a narrow silver iodide distribution among the grains has been prepared stably by a method based on solubility product differences between different kind of silver halide, such as that disclosed in Japanese Patent O.P.I. Publication Nos. 167537/1990, affording the production of a silver halide photographic light-sensitive material (hereinafter also referred to as light-sensitive material) of high sensitivity and excellent graininess.

However, the light-sensitive materials incorporating such grains posed a new problem of granularity deterioration in long-term storage, which had not been predictable in conventional grains.

SUMMARY OF THE INVENTION

The object of the present invention is to provide a process for producing a silver halide photographic light-sensitive material which have high sensitivity and excellent granularity, particularly excellent granularity after long-term storage.

The above object of the invention can be accomplished by a process for producing a silver halide photographic material which has a silver iodide-containing silver halide emulsion layer and a photographic material produced thereby. The process comprises the steps of (1) forming a seed emulsion comprising silver halide seed grains, (2) growing the seed grains to prepare a silver halide photographic emulsion by supplying a silver ion component and a halide ion component to the mother liquid of the seed emulsion, (3) coating and drying the photographic emulsion on a support to form the silver halide emulsion layer, and at least a period during the step for growing the seed grains is performed in the presence of silver iodide grains, and an oxidant capable of converting metallic silver to silver ions is added at a time during the step for growing the seed grains, and a silver halide photographic light-sensitive material produced by the above method.

DETAILED DESCRIPTION OF THE INVENTION

The emulsion containing silver iodide for the present invention, hereinafter referred to as the emulsion relating to the present invention, is desirably a monodispersed silver halide emulsion.

In the present invention, a monodispersed silver halide emulsion means a silver halide emulsion wherein the weight of silver halide grains falling in the grain size range of ±20% of the average grain size d accounts for not less than 70% of the total silver halide weight, preferably not less than 80%, and more preferably not less than 90%.

Here, the average grain size d is defined as the grain size $d_1$ which gives a maximum value for $n_1 \times d_1^3$, wherein $d_1$ denotes the grain size and $n_1$ denotes the number of grains having a diameter of $d_1$, significant up to three digits, rounded off at the last digit.

The grain size stated here is the diameter of a circle converted from a grain projection image with the same area.

Grain size can be obtained by measuring the diameter of the grain or the area of a projected circle on an electron micrograph taken at ×10000 to 50000 magnification, the number of subject grains should be not less than 1000 randomly.

A highly monodispersed emulsion preferred for the present invention has a distribution width of not more than 20%, more preferably not more than 15%, defined as follows.

(Grain size standard deviation/average grain size)×100=distribution width (%)

Here, grain size is measured by the method described above, and average grain size is expressed as arithmetic mean.

Average grain size=$\Sigma dini/\Sigma ni$

The average grain size of the silver halide emulsion of the present invention is preferably 0.1 to 10.0 μm, more preferably 0.2 to 5.0 μm, and ideally 0.3 to 3.0 μm.

The silver halide emulsion of the present invention preferably comprises a silver iodobromide having an average silver iodide content of 4 to 20 mol %, more preferably 5 to 15 mol %.

The silver halide emulsion of the present invention may contain silver chloride as long as the effect of the present invention is not interfered with.

The silver halide emulsion of the present invention preferably has a phase of high silver iodide content in each grain.

The silver iodide content of the high silver iodide content phase is preferably 15 to 45 mol %, more preferably 20 to 42 mol %, and ideally 25 to 40 mol %.

The inner high silver iodide content phase of the silver halide grains of the present invention is coated with a lower silver iodide content phase or a silver chlorobromide phase.

The average silver iodide content of the lower silver iodide content phase, which forms the outermost phase, is preferably not more than 6 mol %, more preferably 0 to 4 mol %. Also, another phase having a silver iodide content falling between that of the outermost phase and that of the high silver iodide content phase, intermediate phase, may be present.

The silver iodide content of the intermediate phase is preferably 10 to 22 mol %, ideally 12 to 20 mol %.

It is preferable that a difference of not less than 6 mol %, more preferably not less than 10 mol %, exists between the outermost phase and the intermediate phase, and between the intermediate phase and the inner high silver iodide content phase.

In the mode of embodiment of the present invention described above, another silver halide phase may be present in the central portion of the inner high silver iodide content phase, between the inner high silver iodide content phase and the intermediate phase, and between the intermediate phase and the outermost phase.

Also, it is preferable that the volume of the outermost phase be 4 to 70 mol % of the entire grain volume, more preferably 10 to 50 mol %. It is desirable that the volume of the high silver iodide content phase be 10 to 80% of the entire grain volume, more preferably 20 to 50%, and still more preferably 20 to 45%. The volume of the intermediate phase is preferably 5 to 60% of the entire grain volume, more preferably 20 to 55%.

Each of these phases may be a single phase of uniform composition, or a group of phases of uniform composition with its composition varying in steps. It may also be a continuous phase wherein continuous composition change occurs in any phase, and may be a combination thereof.

Another mode of embodiment of the present invention is such that the silver iodide content changes continuously from the grain center toward outside, rather than a substantially uniform phase of silver iodide localized in each grain. In this case, the silver iodide content preferably decreases monotonously from the point of maximum silver iodide content toward the outside.

The silver iodide content at the point of maximum silver iodide content is preferably 15 to 45 mol %, more preferably 25 to 40 mol %.

Also, the silver iodide content in the grain surface phase is preferably not higher than 6 mol %, with preference given to a silver iodobromide having a grain surface phase silver iodide content of 0 to 4 mol %.

The silver halide emulsion of the present invention preferably satisfies at least one of the following requirements:

1) The average silver iodide content ($J_1$) obtained by fluorescent X-ray analysis and the grain surface silver iodide content ($J_2$) obtained by X-ray photo-electron spectrometry maintain the relationship of $J_1 > J_2$.

X-ray photo-electron spectrometry is described below.

Prior to X-ray photo-electron spectrometry, the emulsion is pre-treated as follows: First, a pronase solution is added to the emulsion, followed by gelatin decomposition with stirring at 40° C. for 1 hour. Centrifugation is then conducted to precipitate the silver halide grains. After removing the supernatant, an aqueous solution of pronase is added, followed by further gelatin decomposition under the same conditions as above. The sample thus treated is re-centrifuged. After removing the supernatant, distilled water is added to re-disperse the emulsion grains therein, followed by centrifugation and supernatant removal. After this washing procedure is repeated in three cycles, the emulsion grains are re-dispersed in ethanol. The resulting dispersion is thinly applied over a mirror-polished silicon wafer to yield a subject sample.

X-ray photo-electron spectrometric determination is made using, for example, the ESCA/SAM560 model spectrometer, produced by PHI Co., under conditions of Mg-K$\alpha$ ray as the excitation X-ray, 15 KV of X-ray source voltage, 40 mA of X-ray source current and 50 eV of pass energy.

To determine the surface halide composition, Ag3d, Br3d, and I3d 3/2 electrons are detected. The composition ratio is calculated from the integrated intensity in each peak by the relative sensitivity coefficient method. The composition ratio is obtained as an atomic number percent ratio using relative sensitivity coefficients of 5.10, 0.81 and 4.592 for Ag3d, Br3d and I3d3/2, respectively.

2) The above-mentioned average silver iodide content ($J_1$) obtained by fluorescent X-ray analysis and the average value of measurements of silver iodide content on silver halide crystals apart by over 80% from the center of the silver halide grains in the direction of the grain diameter maintain the relationship of $J_1 > J_3$. The center is that of a tangential circle of the grain.

Here, the grain size is the diameter of the tangential circle on the plane which gives a maximum projection area of grain.

The X-ray microanalysis method is described below. Silver halide grains are dispersed in an electron microscopic grid comprising an energy-dispersion type X-ray micro analyzer set on an electron microscope, and magnifying power is set with liquid nitrogen cooling so that a single grain appears in the CRT field. The intensities of AgL$\alpha$ and IL$\alpha$ rays are each integrated for a given period. From the IL$\alpha$/AgL$\alpha$ intensity ratio and the previously drawn working curve, the silver iodide content can be calculated.

3) It is preferable in the invention that the silver halide grains of the emulsion are characterized by the presence of a signal continuously over a range of not less than 1.5 degrees of diffraction angle at a maximum peak height$\times$0.13 of (420) X-ray diffraction using CuK$\alpha$ ray as the irradiation source. It is more preferable that a signal is present continuously over a range of not less than 1.5 degrees, still more preferably not less than 1.8 degrees, and most preferably not less than 2.0 degrees, of diffraction angle at a maximum peak height$\times$0.15. The presence of a signal means that the signal has an intensity exceeding the maximum peak height$\times$0.13.

A more preferred mode of the silver halide emulsion of the present invention is such that the (420) X-ray diffraction signal described above, obtained using CuK$\alpha$ ray as the irradiation source, has two or three peaks, with further preference given to the possession of three peaks.

As a means of examining the crystalline structure of silver halide, X-ray diffraction is known.

As the X-ray irradiation source, various characteristic X-rays can be used, of which the CuK$\alpha$ ray, wherein Cu is the target, is most commonly used.

Since silver iodobromide has a rock salt structure and since its (420) diffraction line with CuK$\alpha$ ray is observed with relatively intense signal at a high angle of $2\theta = 71$ to 74° C., the CuK$\alpha$ ray is most suitable as a tool of crystalline structural determination with high resolution.

In measuring the X-ray diffraction of a photographic emulsion, it is necessary to remove the gelatin, mix a reference sample such as silicon and use the powder method.

The determination can be achieved with reference to "*Kiso Bunseki Kagaku Koza*", vol. 24, "X-ray Analysis", published by Kyoritsu Shuppan.

4) The relative standard deviation of the measurements of average silver iodide content in individual grain is preferably not more than 20%, more preferably not more than 15%, and ideally not more than 12%, as measured by the X-ray microanalysis method for each silver halide grain.

Here, relative standard deviation is obtained by dividing the standard deviation of silver iodide content for at least 100 emulsion grains by the average silver iodide content and multiplying it by a factor of 100.

The silver halide emulsion of the present invention may comprise a normal crystal such as a cubic, tetradecahedral or octahedral crystal, or a twin crystal of tabular or octahedral form.

The silver halide grains may comprise a mixture of these forms.

In the case of an octahedral twin crystal, it is preferable that not less than 60% of the projected area be accounted for by the grains wherein the ratio of the diameter of the circle converted from the same projection area to the grain thickness is lower than 3, more preferably less than 2.0, and still more preferably less than 1.5.

A monodispersed emulsion of normal crystal habit can be produced in accordance with methods such as those disclosed in Japanese Patent O.P.I. Publication Nos. 177535/1984, 138538/1985, 52238/1984, 14331/1985, 35726/1985, 258536/1985 and 14636/1986.

A monodispersed emulsion of twin crystal can be prepared referring the method wherein spherical seed emulsion is grown, such as that disclosed in Japanese Patent O.P.I. Publication No. 14636/1986.

In growing such emulsions, it is preferable to add an aqueous solution of silver nitrate and an aqueous solution of a halide by the double jet method. The rate of addition of each of the solutions is preferably such that no new cores form and no size expansion due to Ostwald ripening occurs, i.e., in the range of from 30 to 100% of the rate of formation of new cores.

As another mode of grain growth, fine grains of silver halide are dissolved and recrystallized to grow them, as described on page 88 of the Proceedings of the 1983 Annual Meeting of the Society of Photographic Science and Technology of Japan.

The preferred growing conditions for silver halide emulsion are a pAg of 5 to 11, a temperature of 40° to 85° C. and a pH of 1.5 to 12.

In the present invention, in forming grains in the presence of silver iodide, it is preferable that so-called seed grains be co-present with a hydrophilic colloid in the mother liquor in advance of addition of the silver iodide, silver solution and halide solution for grain formation.

The above seed grains are described below.

The monodispersed seed grains for the present invention mainly comprise twin crystals.

Here, "mainly comprising twin crystals" means that the number ratio of twin crystals exceeds 50%, preferably not less than 80%, and most preferably not less than 95%.

Monodispersed twin crystal seed grains can be prepared by ripening multi-twin crystal nuclei in the presence of a silver halide solvent to form spherical twin crystal seed grains, as described in Japanese Patent O.P.I. Publication No. 6643/1986, for instance.

Specifically, this method comprises the following processes (a) and (b):

Process (a): A nuclei formation process wherein the pBr of the mother liquid is kept between 2.0 and −0.7 during a starting period of exceeding ½ of the stage of precipitation of a silver halide having a silver iodide content of 0 to 5 mol %.

Process (b): A seed grain formation process which follows the nuclei formation process, wherein a silver halide solvent is added to the mother liquid in a ratio of $10^{-5}$ to 2.0 mol per mol silver halide to form silver halide seed grains which are substantially monodispersed spherical twin crystals.

Here, the mother liquid is a solution, including the silver halide emulsion, used to prepare the silver halide emulsion until a finished photographic emulsion is obtained.

The silver halide grains formed in the nuclei formation process described above are twin crystal grains comprising a silver iodobromide containing 0 to 5 mol % silver iodide.

In the present invention, twin crystal nuclei can be prepared by adding a water-soluble silver salt alone or both a water-soluble silver salt and a water-soluble halide while keeping the aqueous solution of protective colloid at a bromine ion concentration of 0.01 to 5 mol/l i.e, pBr=2.0 to −0.7, preferably 0.03 to 5 mol/l (pBr=1.5 to −0.7) over a starting period of not less than ½ of the core grain formation process.

The nuclei formation process for the present invention is defined as a process which precedes the seed grain formation process, which may include a grain growth period after the period of from initiation of addition of the water-soluble silver salt to the protective colloid solution to substantial termination of formation of new crystal cores.

In the present invention, the size distribution of nuclei is not subjected to limitation, whether it is monodispersed or polydispersed. The polydispersion mentioned herein means that the coefficient of variance for grains, the same as the distribution width described above, exceeds 25%. The nuclei of the present invention preferably contain twin crystal grains in a number ratio of at least 50% to all nuclei, more preferably not less than 70%, and most preferably not less than 90%.

The seed grain formation process wherein the nuclei obtained in the nuclei formation process are ripen in the presence of a silver halide solvent to yield seed grains comprising monodispersed spherical grains is described below.

Ripening in the presence of a silver halide solvent, hereinafter simply referred to as ripening, is considered as different from Ostwald ripening in which in the presence of larger grains and smaller grains, the smaller ones dissolve while the larger ones grow, which result in a wider grain size distribution. With respect to ripening conditions for the seed grains from the nuclei obtained in the nuclei formation process described above, substantially monodispersed spherical seed grains are obtained by ripening the mother liquid, after being subjected to the nuclei formation process in which twin crystal nuclei are formed using a silver halide having a silver iodide content of 0 to 5 mol % described above, in the presence of a $10^{-5}$ to 2.0 mol/mol silver halide solvent. Here, "being substantially monodispersed" means that the distribution width as defined above is less than 25%.

A substantially spherical grain means a grain which is rounded to the extent that {111} planes, {100} planes or other planes are not easily identifiable by electron microphotographic observation of the silver halide grain and wherein if three axes are assumed to intersect with each other at a right angle on a point near the weight center of the grain, the ratio C of the maximum grain diameter L and minimum grain diameter S of the grain in the direction of longitudinal, transversal and vertical directions maintain the relationship of C=L/S=1.0 to 2.0, preferably 1.0 to 1.5.

In the present invention, said spherical grains preferably account for not less than 60% of the all seed grains, more preferably not less than 80%, and it is still more preferable that they account for almost all seed grains.

Examples of the silver halide solvent used in the seed grain formation process for the present invention include (a) the organic thioethers described in U.S. Pat. Nos. 3,271,157, 3,531,289 and 3,574,628, Japanese Patent O.P.I. Publication Nos. 1019/1979 and 158917/1979, and Japanese Patent Examined Publication No. 30571/1983, (b) the thiourea derivatives described in Japanese Patent O.P.I. Publication Nos. 82408/1978, 29829/1980 and 77737/1980, (c) the AgX solvents having a thiocarbonyl group between an oxygen or sulfur atom and a nitrogen atom, described in Japanese Patent O.P.I. Publication No. 144319/1978, (d) the imidazoles described in Japanese Patent O.P.I. Publication No. 100717/1979, (e) sulfites, (f) thiocyanates, (g) ammonia, (h) the hydroxyalkyl-substituted ethylenediamines described in Japanese Patent O.P.I. Publication No. 196228/1982, (i) the substituted mercaptotetrazoles described in Japanese Patent O.P.I. Publication No. 202531/1982, (j) water-soluble bromides, and (k) the benzimidazole derivatives described in Japanese Patent O.P.I. Publication No. 54333/1983.

Examples of these silver halide solvents (a) through (k) are given below.

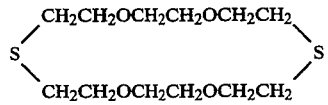
(a)

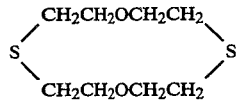

$HOCH_2CH_2SCH_2CH_2SCH_2CH_2OH$

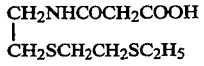

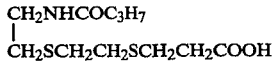

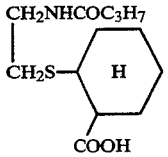

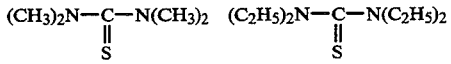
(b)

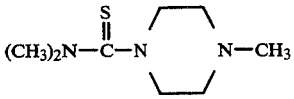

-continued

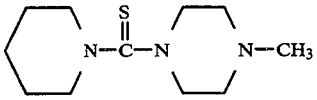

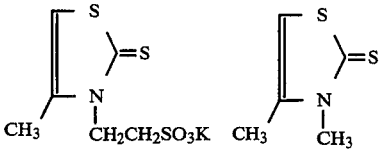
(c)

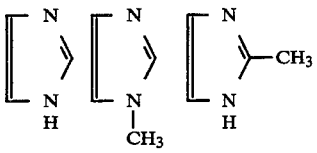
(d)

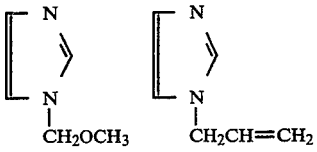

$K_2SO_3$, $Ka_2SO_3$ (e)

$NH_4SCN$, KSCN (f)

$NH_3$ (g)

$(HOCH_2CH_2)_2NCH_2CH_2N(CH_2CH_2OH)_2$ (h)

$(CH_3\underset{\underset{OH}{|}}{C}HCH_2)_2NCH_2CH_2N(CH_2\underset{\underset{OH}{|}}{C}HCH_3)_2$ $(C_2H_5)_2NCH_2CH_2N(CH_2CH_2OH)_2$ $(C_2H_5\underset{\underset{OH}{|}}{C}HCH_2)_2NCH_2CH_2N(CH_2\underset{\underset{OH}{|}}{C}HC_2H_5)_2$

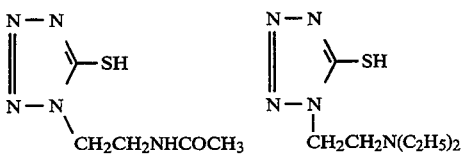
(i)

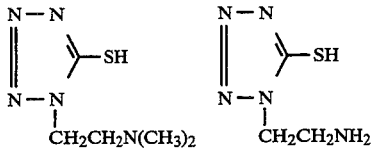

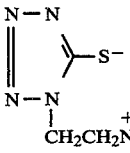

NaBr, $NH_4Br$, KBr (j)

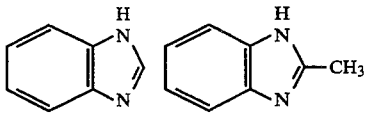
(k)

-continued

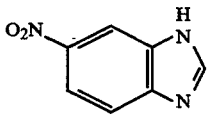

These solvents can be used in combination of two or more kinds. Examples of preferred solvents include thioethers, thiocyanates, thioureas, ammonia and bromides, with further preference given to a combination of ammonia and bromide.

These solvents are used in a ratio of $10^{-5}$ to 2 mol per mol silver halide.

It is preferable that the pH be 3 to 13 and the temperature be 30° to 70° C., with further preference given to a pH of 6 to 12 and a temperature of 35° to 50° C.

As a preferred mode of embodiment of the present invention, an emulsion containing preferred seed grains was obtained by ripening a combination of 0.4 to 1.0 mol/l ammonia and 0.03 to 0.5 mol/l potassium bromide at a pH of 10.8 to 11.2 and a temperature of 35° to 45° C. for 30 seconds to 10 minutes.

To adjust ripening conditions, a water-soluble silver salt may be added during the seed grain formation process of the present invention.

The silver iodide used to form the emulsion (1) for the present invention is described below.

With respect to silver iodide, cubic $\gamma$-AgI and hexagonal $\beta$-AgI are commonly known. The silver iodide used for the present invention may be of any of these crystalline structures, or may be a mixture thereof.

The silver iodide grains used for the present invention is preferably in a form of highly monodispersed suspension, and is preferably prepared by the double jet method while controlling temperature, pH and pAg. Although the grains need not be fine, their average grain size is preferably not less than 0.001 μm and less than 0.7 μm, more preferably not less than 0.005 μm and less than 0.3 μm, and ideally not less than 0.01 μm and less than 0.1 μm.

In forming grains of the emulsion in the presence of silver iodide in the present invention, a silver halide other than silver iodide may be present, and a silver salt solution and a halide solution may be added simultaneously. Preferably, at least three solutions, i.e., a silver salt solution, a halide solution and a silver iodide suspension, are added simultaneously to form grains. Although the halide solution may contain iodine ions, as long as its performance is not interfered with, it preferably contains no iodine ions.

Although the emulsion relating to the present invention is not subject to limitation with respect to the timing of grain formation in the presence of silver iodide, it is best to form the entire phase containing silver iodide in the presence of silver iodide.

For growing seed emulsion grains with fine grains of silver iodide and a supplementary AgX component, an optimum rate of addition free of Ostwald ripening of the growing grains is selected. In the present invention, it is preferable to use an ammoniacal silver nitrate solution and a halide salt solution as the supplementary AgX component.

The silver iodide for the present invention is prepared in a mixing vessel made outside the reaction vessel for emulsion grain formation. It may be added to the reaction vessel immediately after grain formation in the mixing vessel or after grain formation in advance.

The oxidant used for the present invention is a compound capable of converting metallic silver to silver ion. The resulting silver ion may form a silver halide sparingly soluble in water, such as silver halide, or a silver salt highly soluble in water.

Any oxidant can be used for the present invention, whether organic or inorganic. Examples of preferably used oxidants include organic peroxides, quinones, salts of peroxy acid, ozone, hydrogen peroxide and compounds thereof and halogen elements, with preference given to halogen elements, particularly iodine.

In the present invention, the amount of oxidant added is preferably $10^{-8}$ to $10^{-1}$ mol, more preferably $10^{-7}$ to $10^{-2}$ mol, and ideally $10^{-6}$ to $10^{-2}$ mol per mol of the silver halide grains for the present invention.

In the present invention, to add an oxidant to the mother liquid of emulsion, the method used in the field of the art to add additives to silver halide emulsion can be used. It can be added to the mother liquid in which the silver halide grains in the silver halide emulsion of the present invention are grown, after previous dissolution in an appropriate organic solvent such as alcohol, ketone or glycol if it is a compound sparingly soluble or insoluble in water, or in an aqueous solution if it is a water-soluble compound. When using a halogen element, particularly iodine, as an oxidant, it is preferable to previously dissolve it in alcohol before adding to the mother liquid.

In the present invention, the addition of oxidant to the mother liquid in which the silver halide grains in the silver halide emulsion of the present invention are grown may be at a time or in two or more separate steps. Also, the oxidant may be previously added at the time of preparation of the mother liquid in which the silver halide grains in the silver halide emulsion of the present invention are grown, or during the process of growing the silver halide grains. The addition may be achieved in a short time using a funnel etc., or over a long period using a pump etc.

In the present invention, the silver halide emulsions described in Research disclosure No. 308119 (hereinafter referred to as RD308119) can be used. The following table shows where the additives are described.

| Item | Pages in RD308119 |
|---|---|
| Iodine structure | 993, I-Term A |
| Production method | 993, I-Term A and 994, Term E |
| Crystal habit: | |
| Normal crystal | 993, I-Term A |
| Twin crystal | 993, I-Term A |
| Epitaxial | 993, I-Term A |
| Halogen composition: | |
| Uniform | 993, I-Term B |
| Not uniform | 993, I-Term B |
| Halogen conversion | 994, I-Term C |
| Halogen substitution | 994, I-Term C |
| Metal content | 994, I-Term D |
| Monodispersion | 995, I-Term F |
| Solvent addition | 995, I-Term F |
| Site where latent images are formed: | |
| Surface | 995, I-Term G |
| Core | 995, I-Term G |
| Applicable light-sensitive materials: | |
| Negative films | 995, I-Term H |
| Positive films (containing core fogging grains) | 995, I-Term H |
| Emulsion mixture | 995, I-Term J |

-continued

| Item | Pages in RD308119 |
|---|---|
| Desalinization | 995, II-Term A |

In the present invention, the silver halide emulsion is used after physical ripening, chemical ripening and spectral sensitization. Additives used in these processes are described in Research Disclosure Nos. 17643, 18716 and 308119 (hereinafter referred to as RD17643, RD18716 and RD308119, respectively).

The following table shows where the additives are described.

| Item | Page in RD308119 | RD17643 | RD18716 |
|---|---|---|---|
| Chemical sensitizer | 996, III-Term A | 23 | 648 |
| Spectral sensitizer | 996, IV-Terms A, B, C, D, H, I, J | 23–24 | 648–649 |
| Supersensitizer | 996, IV-Terms A, E, J | 23–24 | 648–649 |
| Antifogging agent | 998, VI | 24–25 | 649 |
| Stabilizer | 998, VI | 24–25 | 649 |

Known photographic additives which can be used for the present invention are also described in the above Research Disclosure numbers. The following table shows where they are described.

| Item | Page in RD308119 | RD17643 | RD18716 |
|---|---|---|---|
| Antistaining agent | 1002, VII-Term I | 25 | 650 |
| Dye image stabilizer | 1001, VII-Term J | 25 | |
| Brightening agent | 998, V | 24 | |
| Ultraviolet absorbent | 1003, VIII-Term C, XIII-Term C | 25–26 | |
| Light absorbent | 1003, VIII | 25–26 | |
| Light scattering agent | 1003, VIII | | |
| Filter dye | 1003, VIII | 25–26 | |
| Binder | 1003, IX | 26 | 651 |
| Antistatic agent | 1006, XIII | 27 | 650 |
| Hardener | 1004, X | 26 | 651 |
| Plasticizer | 1006, XII | 27 | 650 |
| Lubricant | 1006, XII | 27 | 650 |
| Activator, coating aid | 1005, XI | 26–27 | 650 |
| Matting agent | 1007, X, VI | 26–27 | 650 |
| Developing agent (contained in the light-sensitive material) | 1011, XX-Term B | | |

The light-sensitive material of the present invention may incorporate various couplers. Examples thereof are described in the above Research Disclosure Numbers. The following table shows where they are described.

| Item | Page in RD308119 | RD17643 |
|---|---|---|
| Yellow coupler | 1001, VII-Term D | VII-Terms C–G |
| Magenta coupler | 1001, VII-Term D | VII-Terms C–G |
| Cyan coupler | 1001, VII-Term D | VII-Terms C–G |
| Colored coupler | 1002, VII-Term G | VII-Term G |
| DIR coupler | 1001, VII-Term F | VII-Term F |
| BAR coupler | 1002, VII-Term F | |
| Other couplers which release a useful residue | 1001, VII-Term F | |
| Alkali-soluble coupler | 1001, VII-Term E | |

The additives used for the present invention can be added by dispersion as described in RD308119 XIV and by other methods.

In the present invention, the supports described on page 28 of RD17643, pages 647 and 648 of RD18716, and RD308119 XIX can be used.

The light-sensitive material may be provided with auxiliary layers such as filter layers and interlayers as described in RD308119, VII-Term K.

The light-sensitive material of the present invention can have various layer structures such as the ordinary layer structure, reverse layer structure and unit structure described in the above RD308119 VII-K.

The present invention is applicable to various color light-sensitive materials represented by color negative films for ordinary or movie use, color reversal films for slides or televisions, color printing papers, color positive films, and color reversal papers.

The light-sensitive material of the present invention can be developed by the ordinary processes described on pages 28 and 29 of the above RD17643, page 647 of RD18716 and RD308119 XIX.

EXAMPLES

Example 1

Preparation of Spherical Seed Emulsion T-I

A monodispersed emulsion comprising spherical grains was prepared as follows:

Solution A

| | |
|---|---|
| Ossein gelatin | 80 g |
| Potassium bromide | 47.4 g |
| 10% methanol solution of sodium salt of polyisopropylene-polyethyleneoxy-disuccinate | 20 ml |

Water was added to make a total quantity of 8.0 1.

Solution B

| | |
|---|---|
| Silver nitrate | 1.2 kg |

Water was added to make a total quantity of 1.6 1.

Solution C

| | |
|---|---|
| Ossein gelatin | 32.2 g |
| Potassium bromide | 840 g |

Water was added to make a total quantity of 1.6 1.

Solution D

| | |
|---|---|
| Aqueous ammonia | 470 ml |

While vigorously stirring solution A at 40° C., solutions B and C were added by the double jet method over a period of 11 minutes to form nuclei. During this operation, a pBr of 1.60 was maintained.

The temperature was then lowered to 30° C. over a period of 12 minutes, followed by 18 minutes of ripening. Solution D was then added over a period of 1 minute, followed by 5 minutes of ripening. The KBr concentration and ammonia concentration were 0.07 mol/l and 0.63 mol/l, respectively, during the ripening.

After completion of ripening, pH was adjusted to 6.0, and desalinization was performed by a conventional method. Electron microscopy of the seed emulsion thus obtained identified it as an emulsion comprising spherical grains having two mutually parallel twin crystal plains and an average rain size of 0.30 μm.

Preparation of Inventive Emulsion EM-1

Using the following seven solutions, a monodispersed emulsion EM-1 relating to the present invention, which comprised octahedral twin crystal grains, was obtained.

Solution A

| | |
|---|---|
| Ossein gelatin | 268.2 g |
| Distilled water | 4.0 l |
| 10% methanol solution of sodium salt of polyisopropylene-polyethyleneoxy-disuccinate | 1.5 ml |
| Seed emulsion T-1 | 0.286 mol |
| 28% by weight aqueous solution of ammonia | 528.0 ml |
| 56% by weight aqueous solution of acetic acid | 795.0 ml |
| Methanol solution containing 0.001 mol of iodine | 50.0 ml |

Distilled water was added to make a total quantity of 5930.0 ml.

Solution B

A 3.5N aqueous solution of ammoniacal silver nitrate. Ammonium nitrate was added to adjust to pH of 9.0.

Solution C

A 3.5N aqueous solution of potassium bromide containing 4.0% by weight gelatin.

Solution D

| | |
|---|---|
| A fine grain suspension comprising 3% by weight gelatin and grains of silver iodide (average grain size 0.05 μm) | 2.39 mol |

This suspension was prepared as follows:

To 5000 ml of a 6.0% by weight gelatin solution containing 0.06 mol potassium iodide, 2000 ml of an aqueous solution containing 7.06 mol silver nitrate and 2000 ml of an aqueous solution containing 7.06 mol potassium iodide were added over a period of 10 minutes. During fine grain formation, a pH of 2.0 was maintained with nitric acid, and temperature maintained at 40° C. After grain formation, an aqueous solution of sodium carbonate was added to obtain a pH of 6.0.

Solution E

| | |
|---|---|
| Fine grain suspension comprising silver iodobromide grains having a silver iodide content of 1 mol % and an average grain size of 0.04 μm, prepared in the same manner as with the fine grain silver iodide suspension prepared with solution D | 6.24 mol |

During fine grain formation, a temperature of 30° C. was maintained.

Solution F

A 1.75N aqueous solution of potassium bromide.

Solution G

A 56% by weight aqueous solution of acetic acid.

To solution A being kept at 70° C. in a reaction vessel were added solutions B, C and D by the triple-jet precipitation method over a period of 163 minutes, followed by addition of solution E at constant rate over a period of 12 minutes, to grow the seed crystal until it reached 1.0 μm in diameter, calculated as a spherical grain.

Solutions B and C were added at an appropriate rate changed as a function of time according to the critical rate of grain growth to prevent both the occurrence of small grains other than growing seed crystals and polydispersion due to Ostwald ripening. Supply of solution D, i.e., the silver iodide fine grain emulsion, was performed while changing the ratio of its addition rate (molar ratio) to the addition rate of the aqueous solution of ammoniacal silver nitrate with respect to grain size (addition time) to prepare a multiple-layered core/shell emulsion.

Also, by using solutions F and G, the pAg and pH during crystal growth were controlled as shown in Table 1. Determination of pAg and pH was made in accordance with standard methods using a silver sulfide electrode and a glass electrode.

After grain formation, desalinization was performed in accordance with the method described in Japanese Patent Application No. 41314/1991, after which gelatin was added and the grains were re-dispersed therein, and pH was adjusted to 5.80 and pAg 8.06 at 40° C.

Scanning electron micrographs of the obtained emulsion grains identified the emulsion as a monodispersed emulsion comprising octahedral twin crystals having an average grain size of 1.0 μm as a spherical grain and a distribution width of 10.3%.

TABLE 1

| | Addition time (min) | Grain size (μm) | Solution D flow rate ratio | pH | pAg |
|---|---|---|---|---|---|
| Core | 0.0 | 0.318 | 10.3 | 7.2 | 7.8 |
| | 23.1 | 0.432 | 10.3 | 7.2 | 7.8 |
| | 38.0 | 0.495 | 10.3 | 7.2 | 7.8 |
| Interlayer | 50.1 | 0.538 | 30.0 | 7.2 | 7.8 |
| | 82.6 | 0.657 | 30.0 | 7.2 | 7.8 |
| | 82.6 | 0.657 | 30.0 | 6.5 | 9.4 |
| Shell | 112.7 | 0.706 | 10.3 | 6.5 | 9.4 |
| | 122.0 | 0.723 | 10.3 | 6.5 | 9.4 |
| | 141.6 | 0.781 | 7.7 | 6.5 | 9.4 |
| | 141.6 | 0.781 | 0.0 | 6.5 | 9.4 |
| | 163.0 | 0.925 | 0.0 | 6.5 | 9.7 |

Preparation of Comparative Emulsion EM-2

Prepared in the same manner as with EM-1 except that the methanol solution of iodine in solution A for EM-1 was removed.

Preparation of Comparative Emulsion EM-3

Prepared in the same manner as with EM-1 except that solution D for EM-1 was replaced with a 3.5N potassium iodide solution H. Solutions C and H were mixed before adding to the reaction vessel.

Preparation of Silver Halide Photographic Light-Sensitive Material Samples

Emulsions EM-1 through EM-3 thus prepared were each subjected to gold/sulfur sensitization. Using EM-2, layers were sequentially formed on a triacetyl cellulose film support in the order from the support side to prepare a multiple layered color photographic light-sensitive material sample No. 101.

The configuration of the thus-obtained multiple layered color photographic light-sensitive material sample No. 101 is as follows.

In the description given below, the amount of addition in silver halide photographic light-sensitive material is expressed in gram per $m^2$, unless otherwise stated. The figures for silver halide and colloidal silver have been converted to the amounts of silver. Figures for the amount of sensitizing dyes are shown in mol per mol of silver.

| Sample No. 101 | |
|---|---|
| Layer 1: Anti-halation layer | |
| Black colloidal silver | 0.16 |
| UV absorbent UV-1 | 0.20 |
| High boiling solvent Oil-1 | 0.16 |
| Gelatin | 1.23 |
| Layer 2: Interlayer | |
| Compound SC-1 | 0.15 |
| High boiling solvent Oil-2 | 0.17 |
| Gelatin | 1.27 |
| Layer 3: Low speed red-sensitive emulsion layer | |
| Silver iodobromide emulsion having an average grain size of 0.38 μm and a silver iodide content of 8.0 mol % | 0.50 |
| Silver iodobromide emulsion having an average grain size of 0.27 μm and a silver iodide content of 2.0 mol % | 0.21 |
| Sensitizing dye SD-1 | $2.8 \times 10^{-4}$ |
| Sensitizing dye SD-2 | $1.9 \times 10^{-4}$ |
| Sensitizing dye SD-3 | $1.9 \times 10^{-5}$ |
| Sensitizing dye SD-4 | $1.0 \times 10^{-4}$ |
| Cyan coupler C-1 | 0.48 |
| Cyan coupler C-2 | 0.14 |
| Colored cyan coupler CC-1 | 0.021 |
| DIR compound D-1 | 0.020 |
| High boiling solvent Oil-1 | 0.53 |
| Gelatin | 1.30 |
| Layer 4: Medium speed red-sensitive emulsion layer | |
| Silver iodobromide emulsion having an average grain size of 0.52 μm and a silver iodide content of 8.0 mol % | 0.62 |
| Silver iodobromide emulsion having an average grain size of 0.38 μm and a silver iodide content of 8.0 mol % | 0.27 |
| Sensitizing dye SD-1 | $2.3 \times 10^{-4}$ |
| Sensitizing dye SD-2 | $1.2 \times 10^{-4}$ |
| Sensitizing dye SD-3 | $1.6 \times 10^{-5}$ |
| Sensitizing dye SD-4 | $1.2 \times 10^{-4}$ |
| Cyan coupler C-1 | 0.15 |
| Cyan coupler C-2 | 0.18 |
| Colored cyan coupler CC-1 | 0.030 |
| DIR compound D-1 | 0.013 |
| High boiling solvent Oil-1 | 0.30 |
| Gelatin | 0.93 |
| Layer 5: High speed red-sensitive emulsion layer | |
| Silver iodobromide emulsion EM-2 | 1.27 |
| Sensitizing dye SD-1 | $1.3 \times 10^{-4}$ |
| Sensitizing dye SD-2 | $1.3 \times 10^{-4}$ |
| Sensitizing dye SD-3 | $1.6 \times 10^{-5}$ |
| Cyan coupler C-2 | 0.12 |
| Colored cyan coupler CC-1 | 0.013 |
| High boiling solvent Oil-1 | 0.14 |
| Gelatin | 0.91 |
| Layer 6: Interlayer | |
| Compound SC-1 | 0.09 |
| High boiling solvent Oil-2 | 0.11 |
| Gelatin | 0.80 |
| Layer 7: Low speed green-sensitive emulsion layer | |
| Silver iodobromide emulsion having an average grain size of 0.38 μm and a silver iodide content of 8.0 mol % | 0.61 |
| Silver iodobromide emulsion having an average grain size of 0.27 μm and a silver iodide content of 2.0 mol % | 0.20 |
| Sensitizing dye SD-4 | $7.4 \times 10^{-5}$ |
| Sensitizing dye SD-5 | $6.6 \times 10^{-4}$ |
| Magenta coupler M-1 | 0.18 |
| Magenta coupler M-2 | 0.44 |
| Colored magenta coupler CM-1 | 0.12 |
| High boiling solvent Oil-2 | 0.75 |
| Gelatin | 1.95 |
| Layer 8: Medium speed green-sensitive emulsion layer | |
| Silver iodobromide emulsion having an average grain size of 0.59 μm and a silver iodide content of 8.0 mol % | 0.87 |
| Sensitizing dye SD-6 | $2.4 \times 10^{-4}$ |
| Sensitizing dye SD-7 | $2.4 \times 10^{-4}$ |
| Magenta coupler M-1 | 0.058 |
| Magenta coupler M-2 | 0.13 |

-continued

| Sample No. 101 | |
|---|---|
| Colored magenta coupler CM-1 | 0.070 |
| DIR compound D-2 | 0.025 |
| DIR compound D-3 | 0.002 |
| High boiling solvent Oil-2 | 0.50 |
| Gelatin | 1.00 |
| Layer 9: High speed green-sensitive emulsion layer | |
| Silver iodobromide emulsion EM-2 | 1.27 |
| Sensitizing dye SD-6 | $1.4 \times 10^{-4}$ |
| Sensitizing dye SD-7 | $1.4 \times 10^{-4}$ |
| Magenta coupler M-2 | 0.084 |
| Magenta coupler M-3 | 0.064 |
| Colored magenta coupler CM-1 | 0.012 |
| High boiling solvent Oil-1 | 0.27 |
| High boiling solvent Oil-2 | 0.012 |
| Gelatin | 1.00 |
| Layer 10: Yellow filter layer | |
| Yellow colloidal silver | 0.08 |
| Antistaining agent SC-2 | 0.15 |
| Formalin scavenger HS-1 | 0.20 |
| High boiling solvent Oil-2 | 0.19 |
| Gelatin | 1.10 |
| Layer 11: Interlayer | |
| Formalin scavenger HS-1 | 0.20 |
| Gelatin | 0.60 |
| Layer 12: Low speed blue-sensitive emulsion layer | |
| Silver iodobromide emulsion having an average grain size of 0.38 μm and a silver iodide content of 8.0 mol % | 0.22 |
| Silver iodobromide emulsion having an average grain size of 0.27 μm and a silver iodide content of 2.0 mol % | 0.03 |
| Sensitizing dye SD-8 | $4.9 \times 10^{-4}$ |
| Yellow coupler Y-1 | 0.75 |
| DIR compound D-1 | 0.010 |
| High boiling solvent Oil-2 | 0.30 |
| Gelatin | 1.20 |
| Layer 13: Medium speed blue-sensitive emulsion layer | |
| Silver iodobromide emulsion having an average grain size of 0.59 μm and a silver iodide content of 8.0 mol % | 0.30 |
| Sensitizing dye SD-8 | $1.6 \times 10^{-4}$ |
| Sensitizing dye SD-9 | $7.2 \times 10^{-5}$ |
| Yellow coupler Y-1 | 0.10 |
| DIR compound D-1 | 0.010 |
| High boiling solvent Oil-2 | 0.046 |
| Gelatin | 0.47 |
| Layer 14: High speed blue-sensitive emulsion layer | |
| Silver iodobromide emulsion EM-2 | 0.85 |
| Sensitizing dye SD-8 | $7.3 \times 10^{-5}$ |
| Sensitizing dye SD-9 | $2.8 \times 10^{-5}$ |
| Yellow coupler Y-1 | 0.11 |
| High boiling solvent Oil-2 | 0.046 |
| Gelatin | 0.80 |
| Layer 15: First protective layer | |
| Silver iodobromide grain emulsion having an average grain size of 0.08 μm and an AgI content of 1.0 mol % | 0.40 |
| UV absorbent UV-1 | 0.065 |
| UV absorbent UV-2 | 0.10 |
| High boiling solvent Oil-1 | 0.07 |
| High boiling solvent Oil-3 | 0.07 |
| Formalin scavenger HS-1 | 0.40 |
| Gelatin | 1.31 |
| Layer 16: Second protective layer | |
| Alkali-soluble matting agent having an average grain size of 2 μm | 0.15 |
| Polymethyl methacrylate having an average grain size of 3 μm | 0.04 |
| Lubricant WAX-1 | 0.04 |
| Gelatin | 0.55 |

In addition to these compositions, a coating aid Su-1, a dispersing agent Su-2, a viscosity controlling agent, hardeners H-1 and H-2, a stabilizer ST-1, an antifogging agent AF-1, two kinds of AF-2 having an average molecular weight of 10000 or 1100000, respectively, and a preservative DI-1 were added to appropriate layers. The amount of DI-1 added was 9.4 mg/m$^2$.
C-1
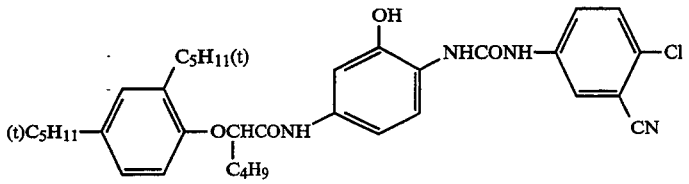
C-2
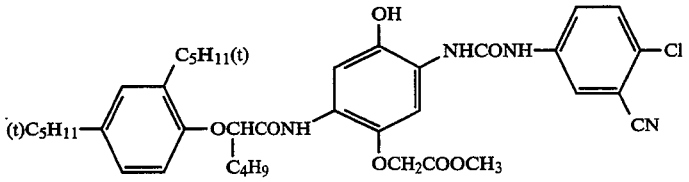
M-1
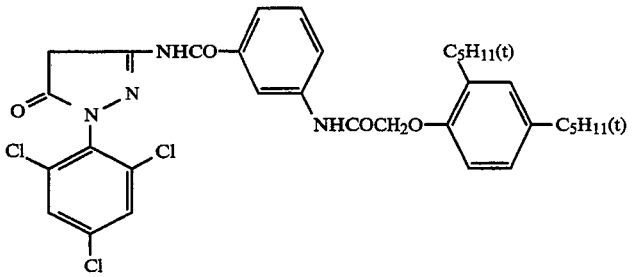
M-2
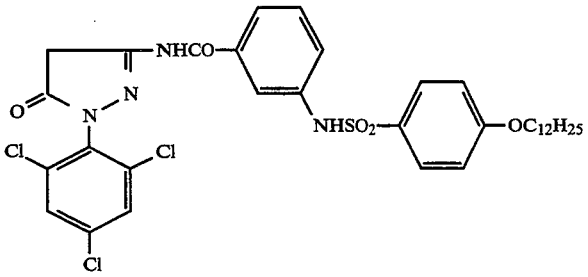
M-3
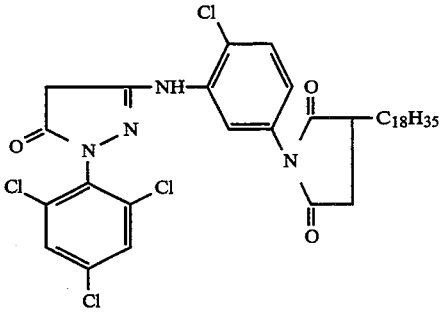
Y-1
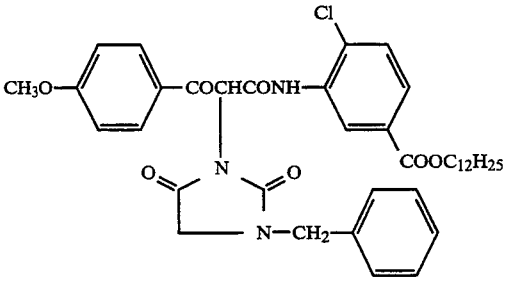
CC-1
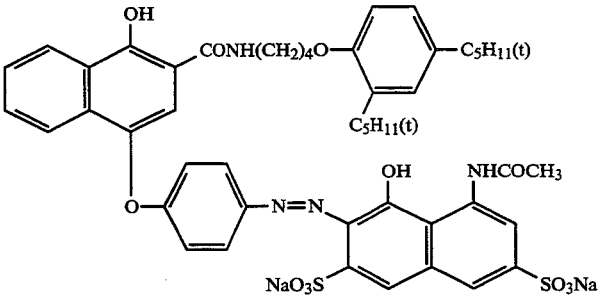

-continued
CM-1
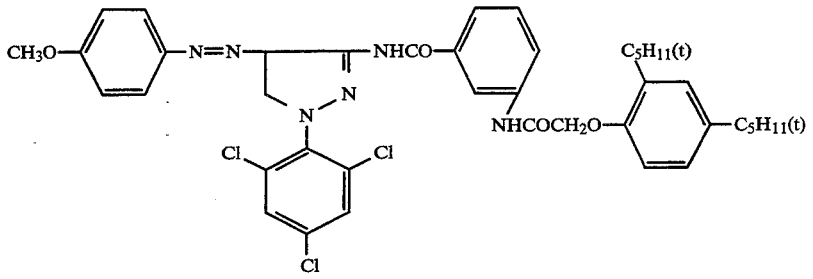
D-1
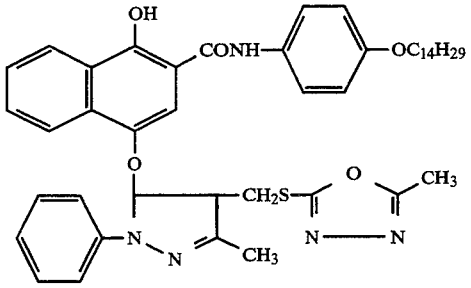
D-2
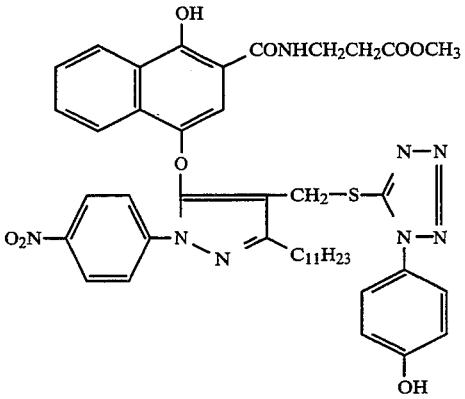
D-3
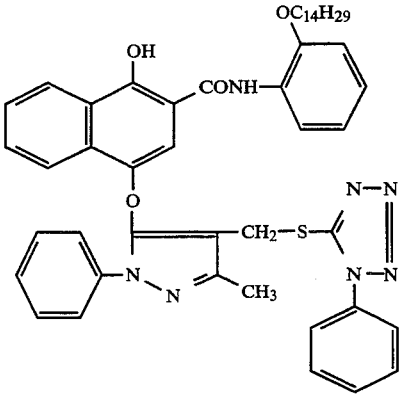
Oil-1
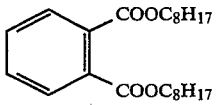
Oil-2
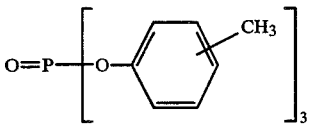
Oil-3
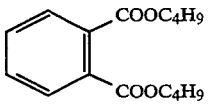
SC-1
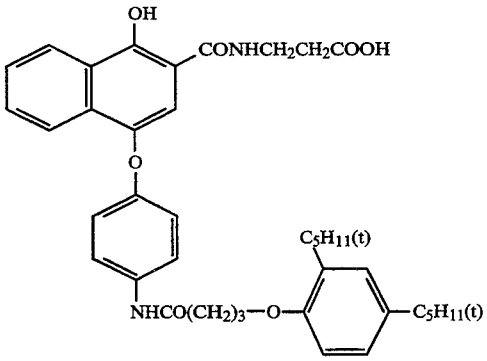
SC-2
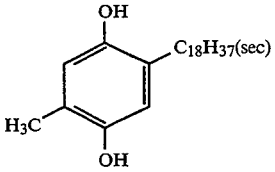

-continued
UV-1
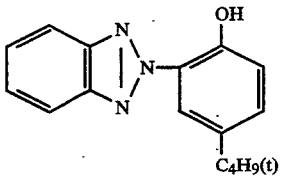
UV-2
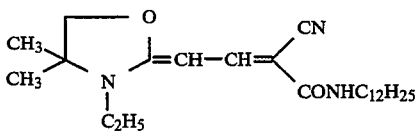
WAX-1
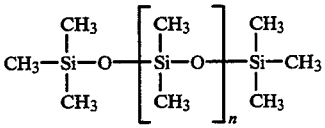
Weight-average molecular weight MW = 3,000
Su-1
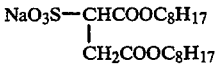
Su-2
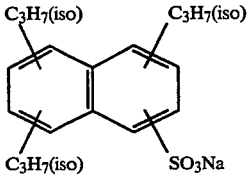
HS-1
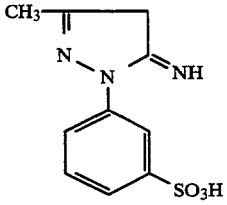
SD-1
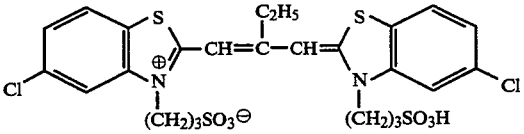
SD-2
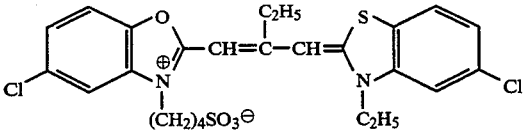
SD-3
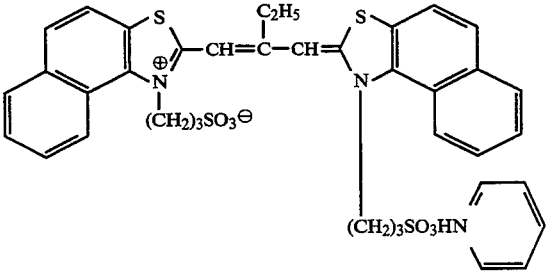
SD-4
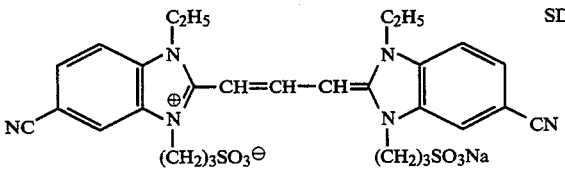
SD-5
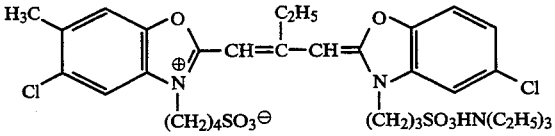
SD-6
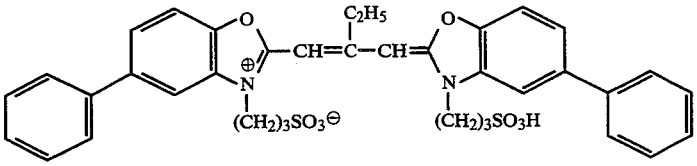
SD-7
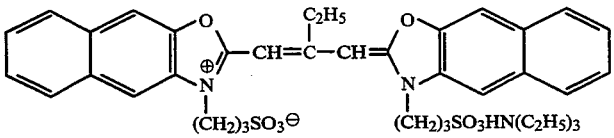

-continued

SD-8

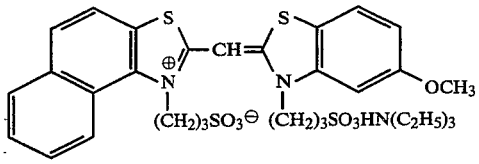

SD-9

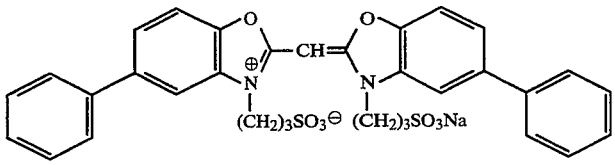

H-1

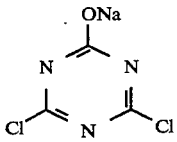

H-2 $(CH_2{=}CHSO_2CH_2)_2O$

ST-1

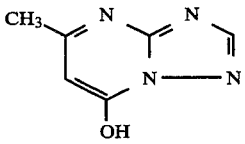

AF-1

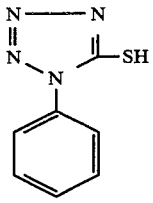

AF-2

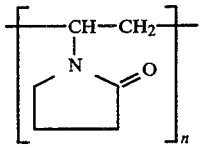

n: Degree of polymerization

DI-1 (mixture of the following three components)

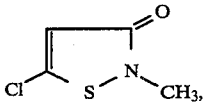

Component A

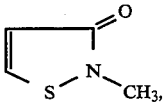

Component B

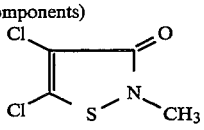

Component C (Component A):(Component B):(Component C) = 50:46:4 (molar ratio)

Next, sample Nos. 102 and 103 were prepared in the same manner as with sample No.101 except that silver iodobromide emulsion EM-2 for layers 5, 9 and 14 was replaced with emulsions EM-3 and EM-1.

Samples Nos. 101 through 103 thus prepared were evaluated for granularity as follows:

Each sample was tested in two portions. One portion was stored at 23° C. and 55% RH for 1 day, after which it was subjected to white light exposure through an optical wedge by a conventional method and processed as described below and evaluated for granularity. The other portion was stored at 40° C. and 80% RH for 5 days, after which it was evaluated for granularity in the same way as above.

| Procedure | Processing time | Processing temperature | Replenishing rate* |
|---|---|---|---|
| Color development | 3 minutes 15 seconds | 38.0 ± 0.3° C. | 780 cc |
| Bleaching | 45 seconds | 38.0 ± 2.0° C. | 150 cc |
| Fixation | 1 minute 30 seconds | 38.0 ± 2.0° C. | 830 cc |

-continued

| Procedure | Processing time | Processing temperature | Replenishing rate* |
|---|---|---|---|
| Stabilization | 60 seconds | 38.0 ± 5.0° C. | 830 cc |
| Drying | 1 minute | 55 ± 5.0° C. | — |

*Figures for replenishing rate are shown per $m^2$ of light-sensitive material.

The color developer, bleaching solution, fixer, stabilizer and replenishers used are as follows:

| Color developer | |
|---|---|
| Water | 800 cc |
| Potassium carbonate | 30.0 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl)aniline sulfate | 4.5 g |
| Diethylenetriaminepentaacetic acid | 3.0 g |

-continued

| Color developer | |
|---|---|
| Potassium hydroxide | 1.2 g |

Water was added to make a total quantity of 1 l, and potassium hydroxide or 20% sulfuric acid was added to obtain a pH of 10.06.

| Color developer replenisher | |
|---|---|
| Water | 800 cc |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-amino-3-methyl-N-ethyl-N-(β-hydroxyl-ethyl)aniline sulfate | 6.3 g |
| Potassium hydroxide | 2 g |
| Diethylenetriaminepentaacetic acid | 3.0 g |

Water was added to make a total quantity of 1 l, and potassium hydroxide or 20% sulfuric acid was added to obtain a pH of 10.18.

| Bleaching solution | |
|---|---|
| Water | 700 cc |
| Ammonium ferric 1,3-diaminopropane-tetraacetate | 125 g |
| Ethylenediaminetetraacetic acid | 2 g |
| Sodium nitrate | 40 g |
| Ammonium bromide | 150 g |
| Glacial acetic acid | 40 g |

Water was added to make a total quantity of 1 l, and aqueous ammonia or glacial acetic acid was added to obtain a pH of 4.4.

| Bleacher replenisher | |
|---|---|
| Water | 700 cc |
| Ammonium ferric 1,3-diaminopropane-tetraacetate | 175 g |
| Ethylenediaminetetraacetic acid | 2 g |
| Sodium nitrate | 50 g |
| Ammonium bromide | 200 g |
| Glacial acetic acid | 56 g |

After aqueous ammonia or glacial acetic acid was added to obtain a pH of 4.4, water was added to make a total quantity of 1 l.

| Fixer | |
|---|---|
| Water | 800 cc |
| Ammonium thiocyanate | 120 g |
| Ammonium thiosulfate | 150 g |
| Sodium sulfite | 15 g |
| Ethylenediaminetetraacetic acid | 2 g |

After aqueous ammonia or glacial acetic acid was added to obtain a pH of 6.2, water was added to make a total quantity of 1 l.

| Fixer replenisher | |
|---|---|
| Water | 800 cc |
| Ammonium thiocyanate | 150 g |
| Ammonium thiosulfate | 180 g |
| Sodium sulfite | 20 g |

-continued

| Fixer replenisher | |
|---|---|
| Ethylenediaminetetraacetic acid | 2 g |

After aqueous ammonia or glacial acetic acid was added to obtain a pH of 6.5, water was added to make a total quantity of 1 l.

| Stabilizer and stabilizer replenisher | |
|---|---|
| Water | 900 cc |
| p-octylphenylpolyoxyethylene ether (n = 10) | 2.0 g |
| Dimethylolurea | 0.5 g |
| Hexamethylenetetramine | 0.2 g |
| 1,2-benzoisothiazolin-3-one | 0.1 g |
| Siloxane L-77, produced by UCC | 0.1 g |
| Aqueous ammonia | 0.5 cc |

Water was added to make a total quantity of 1 l, and aqueous ammonia or 50% sulfuric acid were added to obtain a pH of 8.5.

Evaluation of Granularity

Granularity was evaluated on the basis of RMS values. RMS values were obtained by scanning the developed sample's portion of minimum density +0.1 using a microdensitometer with an open scanning area of 1800 $\mu m^2$ (slit width 10 μm, slit length 180 μm); the data thus obtained was analyzed to obtain standard deviation for density changes among more than 1000 runs of density determination, and the results were expressed in percent ratio relative to the RMS granularity of comparative sample No. 101 for each spectral sensitivity layer. Granularity improves as this value decreases.

The results are summarized in Table 2.

TABLE 2

| | Granularity | | | | | |
|---|---|---|---|---|---|---|
| | 23° C., 55% RH only | | | 40° C., 80% for 5 days | | |
| Sample No. | B | G | R | B | G | R |
| 101 (comparative) | 100 | 100 | 100 | 115 | 115 | 115 |
| 102 (comparative) | 110 | 110 | 110 | 120 | 120 | 120 |
| 103 (inventive) | 90 | 90 | 90 | 95 | 95 | 95 |

From Table 2, it is seen that the present invention, under either set of conditions, offers excellent granularity and undergoes less deterioration during storage.

What is claimed is:

1. A process for forming a silver halide photographic light-sensitive material having a silver iodide-containing silver halide emulsion layer, said process comprising;

forming a seed emulsion comprising silver halide seed grains, growing said seed grains by simultaneously supplying an aqueous solution of a water-soluble silver salt, an aqueous solution of a water-soluble halide, and a suspension of silver iodide grains, to a mother liquid of said seed emulsion to form a silver halide photographic emulsion, and coating and drying said photographic emulsion on a support to form a silver halide emulsion layer, wherein an oxidant capable of converting metallic silver to silver ions is added to said silver halide emulsion during the growth phase of said silver halide seed grains said oxidant comprising elemental iodine.

2. The process of claim 1, wherein said oxidant is added in an amount of from $10^{-8}$ to $10^{-1}$ moles per mol of silver halide.

3. The process of claim 2, wherein said oxidant is added in an amount of from $10^{-7}$ moles to $10^{-2}$ moles per mol of silver halide.

4. The process of claim 3, wherein said oxidant is added in an amount of from $10^{-6}$ moles to $10^{-2}$ moles per mol of silver halide.

5. The process of claim 1, wherein said seed grains mainly comprise monodispersed twin crystals.

6. The process of claim 5, wherein said monodispersed twin seed grains are formed by a process comprising the steps of forming nuclei grains under a condition that pBr value of the mother liquid of said seed grains is maintained at −0.7 to 2.0 during a starting period of exceeding ½ of a stage of precipitation of silver halide having a silver iodide content of 0 to 5 mol %, and forming monodispersed spherical twin seed grains, following said nuclei forming step, in the presence of a silver halide solvent in an amount of $10^{-5}$ moles to 2.0 moles per mol of silver halide.

7. The process of claim 1, wherein said silver iodide grains are a mixture of γ-AgI grains and β-AgI grains in which the number of γ-AgI is larger than that of β-AgI grains.

8. The process of claim 1, wherein said silver iodide grains have an average grain size of 0.001 μm to 0.7 μm.

9. The process of claim 8, wherein said silver iodide grains have an average grain size of 0.005 μm to 0.3 μm.

10. The process of claim 9, wherein said silver iodide grains have an average grain size of 0.01 μm to 0.1 μm.

11. The process of claim 1, wherein said halide compound solution contains no iodide ions.

12. The process of claim 1, wherein silver iodide grains exist over a period for forming a silver iodide phase of said photographic emulsion grains.

13. The process of claim 1, wherein said silver iodide grains are separately prepared in a vessel other than a reacting vessel in which said grain growing step is performed, and added to said mother liquid of seed grains.

14. A silver halide photographic light-sensitive material comprising a support having provided thereon a silver halide emulsion layer comprising silver halide grains containing silver iodide, said silver halide emulsion layer having been prepared by;

forming a seed emulsion comprising silver halide seed grains, growing said seen grains by simultaneously supplying an aqueous solution of a water-soluble silver salt, an aqueous solution of a water-soluble halide, and a suspension of silver iodide grains, to a mother liquid of said seed emulsion to form a silver halide photographic emulsion, and coating and drying said photographic emulsion on said support to form said silver halide emulsion layer, wherein an oxidant capable of converting metallic silver to silver ions is added to said silver halide emulsion during the growth phase of said silver halide seed grains said oxidant comprising elemental iodine.

15. The light-sensitive material of claim 14, wherein said oxidant is added in an amount of from $10^{-8}$ moles to $10^{-1}$ moles per mol of silver halide.

16. The light-sensitive material of claim 15, wherein said oxidant is added in an amount of from $10^{-7}$ moles to $10^{-2}$ moles per mol of silver halide.

17. The light-sensitive material of claim 16, wherein said oxidant is added in an amount of from $10^{-6}$ moles to $10^{-2}$ moles per mol of silver halide.

18. The light-sensitive material of claim 14, wherein said seed grains mainly comprise monodispersed twin crystals.

19. The light-sensitive material of claim 18, wherein said monodispersed twin seed grains formed by a process comprising the steps of forming nuclei grains under a condition that pBr value of the mother liquid of said seed grains is maintained at −0.7 to 2.0 during a starting period of exceeding ½ of a stage of precipitation of silver halide having a silver iodide content of 0 to 5 mol %, and forming monodispersed spherical twin seed grains, following said nuclei forming step, in the presence of a silver halide solvent in an amount of $10^{-5}$ moles to 2.0 moles per mol of silver halide.

20. The light-sensitive material of claim 14, wherein said silver iodide grains are a mixture of γ-AgI grains and β-AgI grains in which the number of γ-AgI is larger than that of β-AgI grains.

21. The light-sensitive material of claim 14, wherein said silver iodide grains have an average grain size of 0.001 μm 0.7 μm.

22. The light-sensitive material of claim 21, wherein said silver iodide grains have an average grain size of 0.005 μm to 0.3 μm.

23. The light-sensitive material of claim 22, wherein said silver iodide grains have an average grain size of 0.01 μm to 0.1 μm.

24. The light-sensitive material of claim 14, wherein said halide compound solution contains no iodide ions.

25. The light-sensitive material of claim 14, wherein silver iodide grains exist over a period for forming a silver iodide phase of said photographic emulsion grains.

26. The light-sensitive material of claim 14, wherein said silver iodide grains are separately prepared in a vessel other than a reacting vessel in which said grain growing step is performed, and added to said mother liquid of seed grains.

* * * * *